US007490679B2

(12) United States Patent
Hachisu

(10) Patent No.: US 7,490,679 B2
(45) Date of Patent: Feb. 17, 2009

(54) BUTTON-ATTACHING DEVICE AND METHOD OF ATTACHING BUTTON TO UPPER DIE OF BUTTON-ATTACHING DEVICE

(75) Inventor: Yoshinori Hachisu, Saitama (JP)

(73) Assignee: YKK Corporation, Tokyo (JP)

( * ) Notice: Subject to any disclaimer, the term of this patent is extended or adjusted under 35 U.S.C. 154(b) by 67 days.

(21) Appl. No.: 10/559,548

(22) PCT Filed: Jun. 3, 2004

(86) PCT No.: PCT/JP2004/008065

§ 371 (c)(1),
(2), (4) Date: Dec. 2, 2005

(87) PCT Pub. No.: WO2004/107891

PCT Pub. Date: Dec. 16, 2004

(65) Prior Publication Data

US 2007/0094860 A1 May 3, 2007

(30) Foreign Application Priority Data

Jun. 6, 2003 (JP) ..... 2003-162136

(51) Int. Cl.
*A41H 37/10* (2006.01)

(52) U.S. Cl. ..... 173/171

(58) Field of Classification Search ..... 173/1, 173/171

See application file for complete search history.

(56) References Cited

U.S. PATENT DOCUMENTS 2,134,404 A 10/1938 Huelster
3,858,462 A * 1/1975 Orlando et al. ..... 79/5
4,019,666 A * 4/1977 Foults ..... 227/119
4,221,139 A * 9/1980 Peterson ..... 79/1
4,703,882 A * 11/1987 Herten ..... 227/8
4,723,357 A * 2/1988 Suyama et al. ..... 29/721
4,744,498 A * 5/1988 Suzuki ..... 227/140
4,978,046 A 12/1990 Hagmann et al.
5,012,573 A * 5/1991 Ito ..... 29/798
5,263,627 A 11/1993 Breuer et al.
5,535,506 A * 7/1996 Chalfin ..... 29/798
6,502,008 B2 * 12/2002 Maurer et al. ..... 700/175
7,051,568 B2 * 5/2006 Ciotti ..... 72/453.01

FOREIGN PATENT DOCUMENTS

CN 1067363 A 12/1992
DE 3616904 C1 8/1987

(Continued)

OTHER PUBLICATIONS

European Search Report for corresponding European patent application No. 04736005.2 dated Nov. 19, 2007 and received Dec. 21, 2007.

*Primary Examiner*—Brian D Nash
(74) *Attorney, Agent, or Firm*—Alston & Bird LLP

(57) ABSTRACT

A button-attaching device 40 includes a snap upper chuck unit 20. A button holder 10 of the chuck unit 20 temporarily holds a button 1, and the button holder 10 is then rotated by a rotating arm 21, so that the button 1 is transferred from the button holder 10 to a button fixing part 31 of an upper die 30.

3 Claims, 3 Drawing Sheets

FOREIGN PATENT DOCUMENTS

| | | | |
|---|---|---|---|
| FR | 1331494 | A2 | 5/1962 |
| JP | 58-9799 | | 1/1983 |
| JP | 60-123181 | | 8/1985 |
| JP | 60-189524 | | 12/1985 |
| JP | 63-123634 | | 8/1988 |
| JP | 4-163304 | | 6/1992 |

* cited by examiner

BUTTON-ATTACHING DEVICE AND METHOD OF ATTACHING BUTTON TO UPPER DIE OF BUTTON-ATTACHING DEVICE

TECHNICAL FIELD

The present invention relates to a button-attaching device and a method of fixing a button to an upper die of the button-attaching device, more specifically to an improved button-attaching device in which a button is fixed to an upper die and a new method of fixing the button to the upper die which is implemented in the improved device.

BACKGROUND ART

Conventionally, there have been generally used button-attaching devices in attaching a button to a fabric of a garment or the like in the industry (see, for instance, Japanese Patent Applications No. 58-9799 and No. 4-163304 and Japanese Utility Model Application No. 60-189524).

The button-attaching devices described above each include an upper die that can be lifted up and down and a lower die that is supported on the lower side of the upper die. When a button is attached using these button-attaching devices, first, the button is fixed to the upper die, and then a socket or a stud as a coupler coupling with the button is inserted to and set on the lower die. Next, after placing a garment fabric on the lower die, an operator lifts down the upper die while checking an attaching position. Due to the operation, an attachment part (eyelet, prong, etc.) projecting from the button penetrates the garment fabric, which is then bent and caulked to be integrally coupled with the above-described socket or stud, and thereby the button is attached to the garment fabric.

Note that, there is another method in which the button is fixed to the lower die, but the method causes the button to be placed under the garment fabric and impedes the operator from observing the attaching position on the garment fabric. Therefore, it is common to fix the button to the upper die as described above. Further, although there is another device capable of automatically feeding and fixing the button to the upper die, in a case where, for instance, production quantity of a garment or the like is small or various types of buttons are attached to the garment, attachment work can be performed more smoothly by manually fixing the button to the upper die rather than using such automatic device.

However, in the button-attaching device described above, when the button is manually fixed to the upper die, the button is inserted into the upper die from the upper face of the button. Thus, when the upper face of the button has a design that is orientated, the operator cannot observe the upper face of the button in fixing the button to the upper die, which might cause a circumferential position of the design to be displaced. In addition, much attention is required to perform such positioning work precisely, resulting in degrading workability.

Further, since the button is inserted and fixed to a dented fixing part of the upper die, the operator has to hold with his/her fingers the above-described attachment part (eyelet, prong, etc.) that shapes like a pin projecting from a body of the button, so that the operator feels pain on the fingers after a long work.

DISCLOSURE OF THE INVENTION

An object of the present invention is to provide a button-attaching device and a method of fixing a button to an upper die of the button-attaching device which can enable an operator to fix the button to the upper die with an easy circumferential positioning of the button and without holding an attachment part of the button.

A button-attaching device according to an aspect of the present invention includes: an upper die for fixing a button; a lower die on which a button coupler to be coupled with the button with a fabric interposed therebetween is disposed; and a button holder for temporarily holding the button, in which the button is fixed to the upper die by transferring the button held by the button holder to the upper die.

According to the aspect of the present invention, since the button holder is provided to the button-attaching device, in order to fix the button to the upper die, the button is first held by the button holder instead of being directly fixed to the upper die, and then the button held by the button holder is transferred to the upper die. Unlike a case where the button is directly fixed to the upper die, an operator can perform a setting operation of the button in the button holder with an upper face of the button faced upward and observing a circumferential position of a design on the upper face of the button, and further by holding a circumference of the button (outer circumference of a flange) with his/her fingers.

In the button-attaching device according to the present invention, it is preferable that the button holder includes a button holder moving unit for moving the button holder between a button holding position for holding the button with the button holder and a button transferring position for transferring the button from the button holder to the upper die.

For convenience of the setting operation of the button in the button holder, the button holding position is preferably located on the lower side of the upper die in its standby position. Also, the button holding position is preferably located out of an area of a lifting path of the upper die so that the upper die being lifted down does not collide with the button holder. However, as described later in detail, the button holder can be so designed as to automatically move outside the area of the lifting path in conjunction with a lift-down motion of the upper die. On the other hand, the button transferring position is directly below the upper die in its standby position, where the button holder contacts with the upper die.

Although the above-described button holder moving unit can be designed so as to automatically lift up and down the button holder between the button holding position and the button transferring position, a mechanism will be large scale and cost much, and thus the button holder moving unit is preferably manual or semi-manual.

In the button-attaching device according the present invention, it is preferable that the button holder moving unit moves the button holder along a circular trajectory between the button holding position and the button transferring position.

By rotating the button holder along a circular trajectory between the button holding position and the button transferring position, it becomes unnecessary to move the button holder in a direction other than the circular trajectory. More specifically, in a case where, for instance, the button holder is moved vertically, when the upper die is lifted down, the button holder must be moved in a direction other than the vertical direction (i.e., horizontal direction) in order to move the button holder outside the lifting path of the upper die. Even in a case where the button holder is moved horizontally, at least a slight vertical movement of the button holder is required in transferring the button from the button holder to the upper die. However, according to the aspect of the present invention, by moving the button holder along the circular trajectory, the button holder can be properly moved outside the lifting path when the upper die is lifted down.

In the button-attaching device according to the present invention, it is preferable that the button holder moving unit includes: a rotating shaft; a rotating member that is rotatable around the rotating shaft, one end of the rotating member being connected to the button holder; and a resilient member connected to the rotating member, the resilient member acting so that the button holder moved away from the button holding position returns to the button holding position.

In such case, the operator rotates the rotary shaft to move the button holder in which the button is set at the button holding position to the button transferring position. After the button is transferred to the upper die, the operator releases the rotating shaft. Then, the rotating shaft rotates toward the button holding position due to resilient force of the resilient member, so that the button holder automatically returns to the initial button holding position. The resilient member can be exemplified by a spring, a rubber and the like.

The button-attaching device according to the present invention further includes: a unit for moving the button holder away from a lifting path of the upper die in conjunction with a lift-down motion of the upper die.

In a case where a position of the button holder is within the area of the lifting path of the upper die, since the button holder impedes the upper die from being lifted down, the unit forcibly moves the button holder outside the lifting path of the upper die in conjunction with the lift-down motion of the upper die. An example of the unit will be described later in "Best Mode for Carrying out the Invention".

In the button-attaching device according to the present invention, it is preferable that the button holder includes a projection or a dent corresponding to a notch or a tab as a marker for a circumferential position of the button.

With the arrangement of the present invention, even when the button does not have the notch or the tab, the button can be set on the button holder by observing the design of the upper face of the button as described above. Therefore, the circumferential positioning of the button can be facilitated as compared to the case where the upper face of the button cannot be observed. Incidentally, when the button has the notch or the tab, and further, the button holder is provided with the corresponding projection or dent, the setting operation of the button can be performed even more easily and precisely.

A method for fixing a button to an upper die of a button-attaching device according to another aspect of the present invention includes: temporarily holding the button with a button holder; and transferring the button held in the button holder to the upper die.

The method include a step for holding the button with the button holder and then a step for transferring the button held by the button holder from the button holder to the upper die, prior to fixing the button to the upper die,. When the button is held by the button holder, the circumferential positioning of the button can be performed.

In the method of the present invention, when the button is fixed to the upper die, the button is first held by the button holder instead of being directly fixed to the upper die, and then the button held by the button holder is transferred to the upper die.

Unlike a case where the button is directly fixed to the upper die, the operator can perform the setting operation of the button in the button holder with the upper face of the button faced upward and observing the circumferential position of the design on the upper face of the button, and further by holding the circumference of the button (outer circumference of the flange) with his/her fingers.

BEST MODE FOR CARRYING OUT THE INVENTION

Although a preferred embodiment of the present invention will be described referring to the attached drawings, the present invention is not limited thereto.

Figure 1:
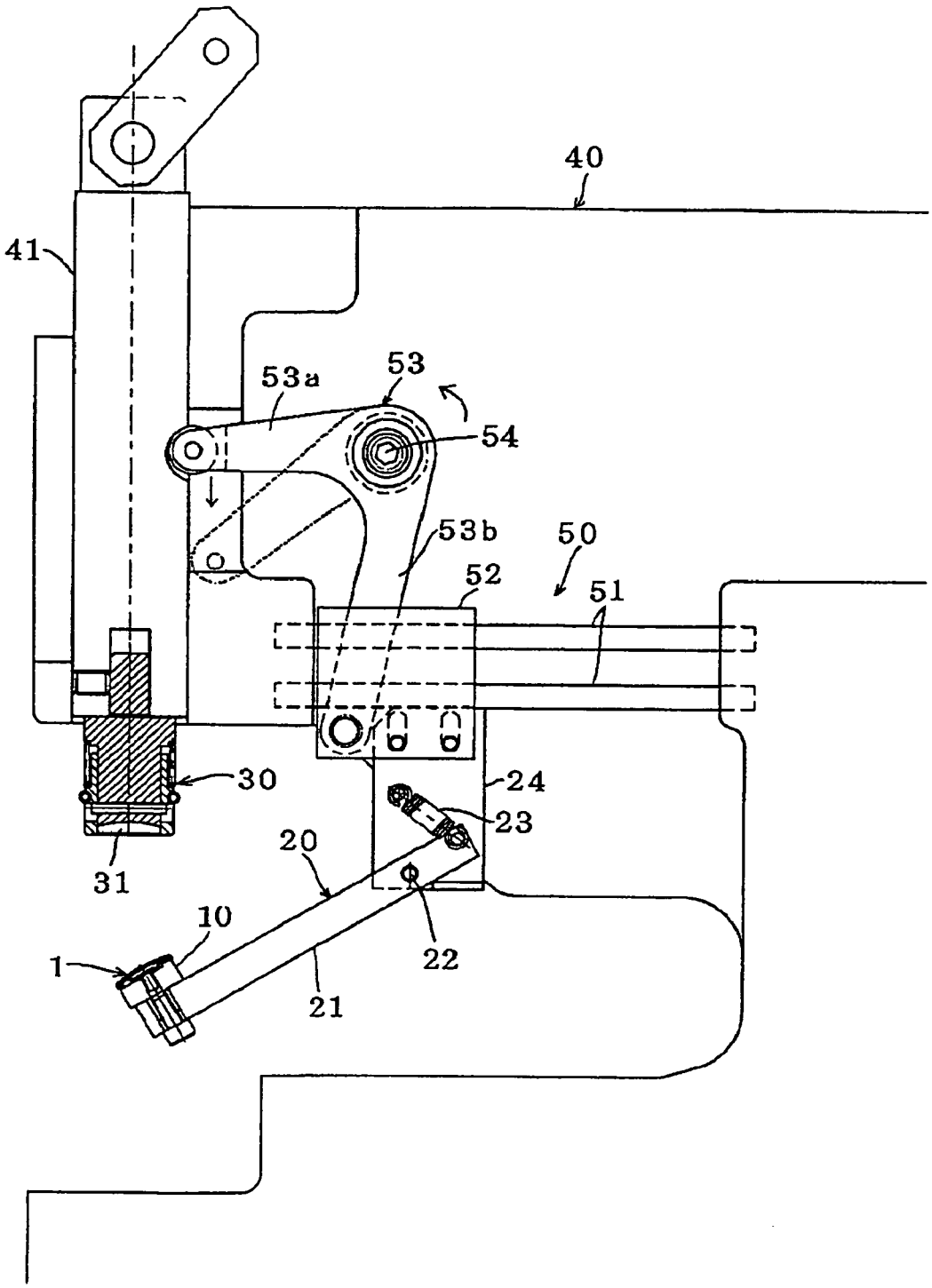
FIG. 1 is a side view schematically showing a button-attaching device.

FIG. 1 is a partial side view schematically showing a button-attaching device 40 according to the present invention, which shows an example of how a later-described snap upper chuck unit (a combination of a button holder and a button holder moving unit) is provided to a button-attaching device body.

The button-attaching device includes an upper die 30 shown in its standby position (uppermost position) and a lower die (not shown) disposed on the lower side of the upper die 30, the upper die 30 lifted up and down by a plunger 41. The button-attaching device 40 is provided with the snap upper chuck unit (hereinafter simply referred to as "chuck unit") 20, the chuck unit 20 including the button holder 10 for holding a button 1 and the button holder moving unit for circularly moving the button holder 10, the button holder moving unit having a rotating arm 21, a rotating shaft 22 and a spring 23.

Figure 2:
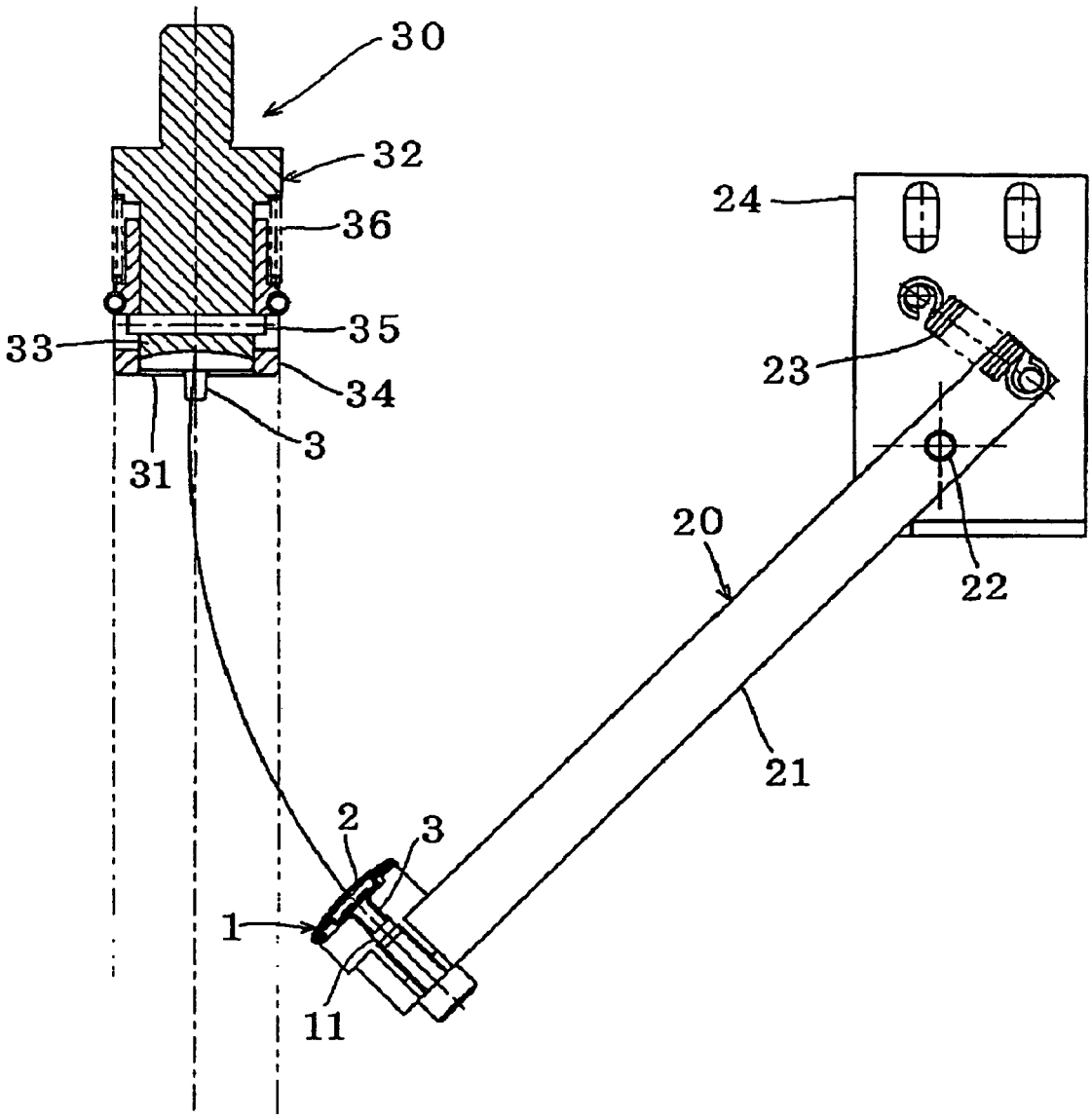
FIG. 2 is an illustration of an upper die and a snap upper chuck unit.

FIG. 2 is an illustration of the upper die 30 and the chuck unit 20, in which the button 1 is set on both on the upper die 30 and the button holder 10 for convenience of description. The upper die 30 has a button fixing part 31 on a lower end, the button fixing part 31 being a dent facing downward so as to catch the button 1. Since the arrangement of the upper die 30 is similar to the related art, a detailed description of the button fixing part 31 will be omitted, but the button fixing part 31 includes: a column-like part (columnar part) 33 defining the lower side of an upper die body 32 with a base end (upper end) being connected to the plunger 41; and a cylindrical member 34 that is attached to a circumference of the columnar part 33 via a pin 35 and a spring 36 in such a manner that an lower end of the cylindrical member 34 is slightly projected downward relative to a lower end of the columnar part 33 under normal condition. Incidentally, when the upper die 30 is pressed into contact with the lower die, the columnar part 33 is displaced downward relative to the cylindrical member 34 against biasing force of the spring 36, so that the button 1 is pushed out from the button fixing part 31. A lower face of the columnar part 33 is formed in a concaved sphere to fit a shape of the upper face of the button 1.

In the chuck unit 20, the rotating arm 21 is rotatable around the rotating shaft 22, a rotating end of which is connected to the button holder 10, while the opposite end of which is provided with the spring 23 at a position between the opposite end and the supporter 24. The rotating shaft 22 is slightly spaced apart from the end on the spring side of the rotating arm 21. The supporter 24 is connected to a horizontal slider of the button-attaching device 40, which will be described later.

The chuck unit 20 is so designed that, when the rotating arm 21 is manually rotated against biasing force of the spring 23 (clockwise in FIG. 2) from a balanced condition shown in FIG. 2, the button holder 10 directly faces the button fixing part 31 of the upper die 30 in its standby position (FIG. 3), and then when the rotating arm 21 is released, the button holder 10 and the rotating arm 21 return to the balanced condition in FIG. 2 due to the force of the spring 23.

Figure 4:
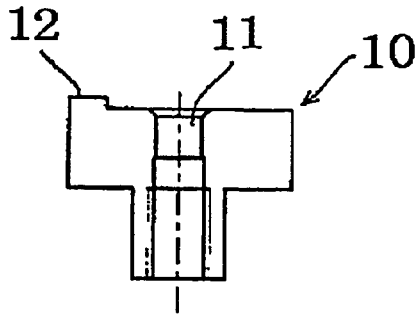
FIG. 4 is a cross section of the button holder.
Figure 5:
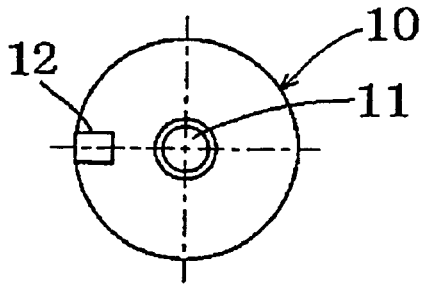
FIG. 5 is a plan view of the button holder.

The button 1 has a button body 2 and an attachment part 3 projecting from the center of a back side of the button body 2, the attachment part 3, although not shown, being coupled to a button coupler disposed on the lower die with a garment fabric interposed therebetween. As shown in FIGS. 4 and 5, the button holder 10 has a button holding part 11 that can fit the attachment part 3 of the button 1 for holding the button 1, the button holder 10 having a diameter smaller, even slightly, than that of the button body 2 as an object to be held for convenience in transferring the button 1 to the upper die 30 (described later). Further, when the button 1 has a notch or a tab as a marker for a circumferential position, the button holder 10 is provided with a projection or a dent corresponding to the marker. FIGS. 4 and 5 show an example where a projection 12 is provided. Incidentally, plural types of button holders having a projection or a dent, etc. can be used for the rotating arm 21 so that the button holders can be replaced corresponding to various types of buttons.

Next, an attachment procedure of the button 1 to the upper die 30 will be described. First, the button 1 is held by the button holder 10 of the chuck unit 20 in the balanced condition (FIG. 2). In this case, the position is defined as a button holding position. At this time, an operator can hold a circumference of the button body 2, and insert the attachment part 3 into the button holding part 11 of the button holder 10 while observing the upper face of the button 1. Unlike attachment to the upper die 30, where the operator cannot observe the upper face of the button, the operator does not feel pain on his/her fingers and does not have to pay much attention in the circumferential positioning of the button 1, thus greatly enhancing the workability. Further, the arrangement in which the projection 12 of the button holder 10 is fitted into the notch of the button 1 allows the operator to observe the design on the upper face of the button 1 and to expect a matching position. This operation can be performed by holding the circumference of the button body 2 and rotating the button slightly, which is quite easy.

Figure 3:
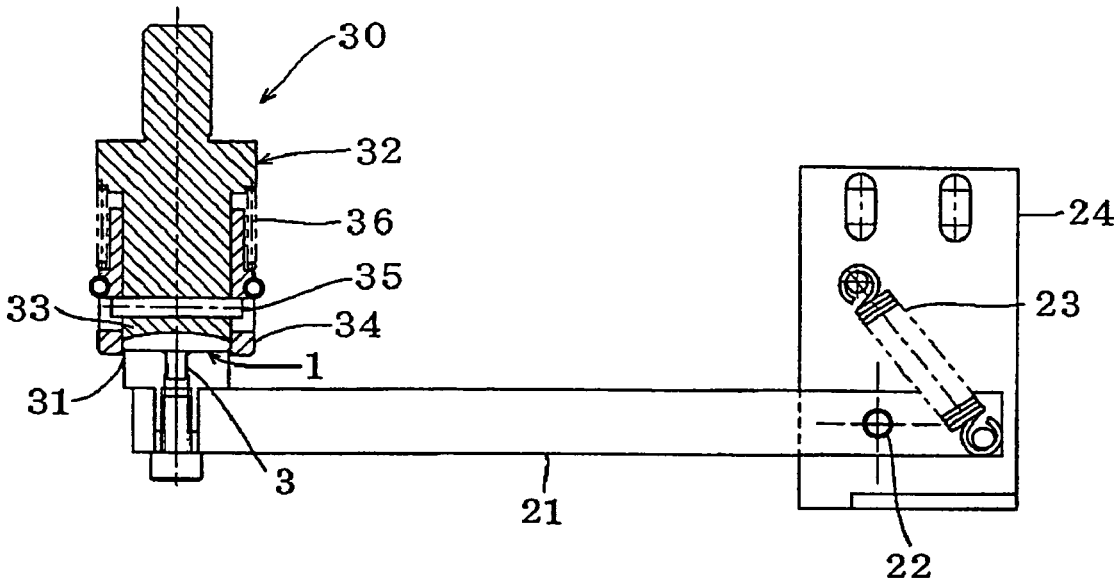
FIG. 3 is an illustration showing how a button is transferred from a button holder to the upper die.

After the button 1 is held by the button holder 10, the rotating arm 21 is rotated in a lifting manner. Due to this operation, the button holder 10 is positioned directly below the upper die 30 (button transferring position) as shown in FIG. 3, so that the button 1 can be transferred from the button holder 10 to the button fixing part 31 of the upper die 30. More specifically, by pressing the button holder 10 to the upper die 30 via the rotating arm 21, the button 1 is fitted into the button fixing part 31. Under the condition, holding force of the cylindrical member 34 of the upper die 30 for holding the button body 2 exceeds holding force of the button holding part 11 of the button holder 10 for holding the attachment part 3 of the button (the button fixing part 31 and the button holding part 11 are so set as to satisfy the condition), so that when the rotating arm 21 is released downward from the upper die 30, the button 1 stays in the upper die 30, not in the button holder 10. By releasing the rotating arm 21 after confirming that the button 1 stays in the upper die 30, the button holder 10 and the rotating arm 21 return to the balanced condition due to the force of the spring 23. Then, although the button 1 is to be attached to the garment fabric by lifting down the upper die 30 as normal, the upper die 30 cannot be lifted down if the button holder 10 and the rotating arm 21 that have returned to the balanced condition exist in a lifting path of the upper die 30 (FIG. 1). In order to improve this point, the chuck unit 20 can be moved in conjunction with the lift-down motion of the upper die 30.

Specifically, a slide mechanism 50 for horizontally moving the chuck unit 20 in a back and forth direction (right and left direction in FIG. 1) in conjunction with a vertical motion of the upper die 30 is provided on the back side (right side in FIG. 1) of the upper die 30 of the button-attaching device 40. The slide mechanism 50 includes guide rails 51 disposed along the back and forth direction, a slider 52 that is slidable in the back and forth direction along the guide rails 51 and connected to the supporter 24, and a motion transmitter 53 having a substantially L-shape and converting the vertical motion of the plunger 41 into the motion in the back and forth direction to transmit to the slider 52. The motion transmitter 53 includes two arm pieces 53*a*, 53*b*, in which a tip end of a first arm piece 53*a* is engaged with a lateral side of the plunger 41, while a tip end of a second arm piece 53*b* is connected to the slider 52, and an intersecting part of the arm pieces 53*a*, 53*b*, namely a central part of the motion transmitter 53, is rotatably supported on a frame of the button-attaching device 40 by a shaft 54.

When the plunger 41 moves downward to lift down the upper die 30, the first arm 53*a* (Translator's comment: correctly, first arm piece 53*a*) of the motion connector 53 (Translator's comment: correctly, motion transmitter 53) moves downward together with the plunger 41 to rotate the motion connector 53 (Translator's comment: correctly, motion transmitter 53) counter-clockwise, so that the second arm 53*b* (Translator's comment: correctly, second arm piece 53*b*) moves the slider 52 backward, in conjunction with which the chuck unit 20 moves backward to cause the button holder 10 to move outside of the lifting path of the upper die 30. When the plunger 41 moves upward, in contrast, the first arm 53*a* (Translator's comment: correctly, first arm piece 53*a*) is moved upward to rotate the motion transmitter 53 clockwise, which causes the chuck unit 20 to return via the second arm 53*b* (Translator's comment: correctly, second arm piece 53*b*) and the slider 52 to a front position where the operator can set the button 1 easily.

According to the present embodiment described above, advantages described below can be obtained.

Specifically, since the button 1 is fixed to the upper die 30 of the button-attaching device 40 through a step for holding the button 1 with the button holder 10, the operator can easily perform the circumferential positioning of the button 1 while observing the design of the upper face of the button 1.

In addition, since the operator can hold the circumference of the button in setting the button 1 to the button holder 10, the operator does not feel pain on his/her fingers even after long work and can easily position the button 1 by rotating the button 1, as compared to a case where the operator holds the attachment part of the button 1 in, for instance, fixing the button 1 to the upper die 30.

Therefore, since the operator does not have to pay much attention in the circumferential positioning of the button 1, the workability can be enhanced greatly.

With the arrangement including the rotating arm 21, the rotating shaft 22 and the spring 23 as the button holder moving unit, the operator can rotate the button holder 10 in which the button 1 is set at the button holding position by rotating the rotating shaft 22 to move the button holder 10 to the button transferring position. Then, after the button 1 is transferred to the upper die 30, when the operator releases the rotating shaft 22, the rotating shaft 22 is rotated toward the button holding position due to the resilient force of the resilient member (spring 23), so that the button holder 10 can automatically return to the initial button holding position.

With the slide mechanism 50 for moving the button holder 10 away from the lifting path of the upper die 30, the button holder 10 can be forcibly moved outside the lifting path in conjunction with the lift-down motion of the upper die 30, so that even if the button holder 10 exists in the area of the lifting path of the upper die 30, a possibility for the lift-down motion of the upper die 30 to be impeded can be avoided.

Since the button holder 10 includes the projection 12 or the dent corresponding to the notch or the tab as a marker for the circumferential position of the button 1, even when the button 1 does not have the notch or the tab, the operator can set the button 1 in the button holder 10 while observing the design on the upper face of the button 1 as described above. Therefore, the circumferential positioning of the button 1 can be facilitated as compared to the case where the upper face of the button cannot be observed.

Since the projection 12 corresponding to the notch of the button 1 is provided to the button holder 10, the setting operation can be performed even more easily and precisely due to the engagement between the notch and the projection 12.

INDUSTRIAL APPLICABILITY

The present invention relates to a method of manually fixing a button to an upper die and an improved button-attaching device, which is applicable in attaching the button to a garment or the like using the button-attaching device.

The invention claimed is:

1. A button-attaching device comprising:

an upper die for fixing a button;

a lower die on which a button coupler to be coupled with the button with a fabric interposed therebetween is disposed;

a button holder for temporarily holding the button and transferring the button held by the button holder to the upper die, and a button holder moving unit for moving the button holder between a button holding position for holding the button with the button holder and a button transferring position for transferring the button from the button holder to the upper die, wherein the button holding position is located outside a lifting path of the upper die, the button transferring position is located within the lifting path of the upper die, and the button holder moving unit includes: a fixed shaft; a rotating member that is rotatable around the rotating shaft, one end of the rotating member being connected to the button holder; and a resilient member connected to the rotating member to move the button holder along a circular trajectory between the button holding position and the button transferring position, the circular trajectory being described around the fixed shaft, the resilient member biasing the button holder away from the upper die.

2. The button-attaching device according to claim 1, further comprising:

a unit for moving the button holder away from the lifting path of the upper die in conjunction with a lift-down motion of the upper die.

3. The button-attaching device according to claim 1, wherein the button holder includes a projection or a dent corresponding to a notch or a tab as a marker for a circumferential position of the button.

* * * * *